US008449075B2

(12) United States Patent
Shimomura et al.

(10) Patent No.: US 8,449,075 B2
(45) **Date of Patent: *May 28, 2013**

(54) INK JET RECORDING HEAD

(75) Inventors: Akihiko Shimomura, Yokohama (JP); Toshihiko Ujita, Yokohama (JP); Takashi Fukushima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/182,501

(22) Filed: Jul. 14, 2011

(65) Prior Publication Data

US 2011/0267403 A1 Nov. 3, 2011

Related U.S. Application Data

(62) Division of application No. 12/120,826, filed on May 15, 2008, now Pat. No. 8,007,069.

(30) Foreign Application Priority Data

May 25, 2007 (JP) ..... 2007-139157
Aug. 24, 2007 (JP) ..... 2007-218217

(51) Int. Cl.
*B41J 2/135* (2006.01)
*B41J 2/015* (2006.01)
*B41J 2/04* (2006.01)

(52) U.S. Cl.
USPC ..... 347/44; 347/20; 347/54

(58) Field of Classification Search
USPC ..... 347/20, 54
See application file for complete search history.

(56) References Cited

U.S. PATENT DOCUMENTS

| | | | | |
|---|---|---|---|---|
| 4,943,516 | A | 7/1990 | Kamayachi et al. | |
| 6,592,202 | B2 | 7/2003 | Udagawa et al. | |
| 6,598,957 | B2 | 7/2003 | Yamamoto et al. | |
| 6,976,754 | B2 * | 12/2005 | Ohashi et al. | 347/92 |
| 8,007,069 | B2 * | 8/2011 | Shimomura et al. | 347/20 |
| 2005/0078143 | A1 | 4/2005 | Shimomura et al. | |
| 2007/0139467 | A1 | 6/2007 | Kihara et al. | |

FOREIGN PATENT DOCUMENTS

JP 2000-26575 A 1/2000

* cited by examiner

*Primary Examiner* — Matthew Luu
*Assistant Examiner* — Lisa M Solomon
(74) *Attorney, Agent, or Firm* — Fitzpatrick, Cella, Harper & Scinto

(57) ABSTRACT

An ink jet recording head comprises a discharge port forming member that forms a discharge port used to discharge ink and a channel forming member that forms an ink channel communicating with the discharge port, at least either one of the channel forming member and the discharge port forming member comprising a substance having fluorine atoms and a rubber member composing a part of an ink passage continuous with the channel, the rubber member being cross-linked by an organic substance.

11 Claims, 4 Drawing Sheets

INK JET RECORDING HEAD

This is a division of U.S. patent application Ser. No. 12/120,826, filed May 15, 2008.

BACKGROUND OF THE INVENTION

1. Field of the Invention

The present invention relates to ink jet recording heads for use in ink jet recording systems or the like.

2. Description of the Related Art

An ink jet recording head (hereinafter referred to as a "recording head") typically has a substrate that includes at least: a plurality of discharge ports through which ink is discharged; a channel communicating with each discharge port; a supply opening for supplying the ink to the channel; and an energy producing element that applies discharging energy to the ink in the channel. The recording head also has: a support member supporting the substrate; and an ink supply passage defining member for supplying ink to the substrate. A Si (silicon) substrate is generally used as a substrate. The ink supply passage defining member is formed from plastic or a similar material. A channel forming member is formed from a photosensitive resin, especially, from a catalyst for photo-polymerization and a cationic polymerization resin, which can be polymerized by light. Examples of such a catalyst for photo-polymerization include photo-acid generating agents containing fluorine atoms, such as iodonium salt of antimony fluoride, sulfonium salt of antimony fluoride, and sulfonium salt of phosphorus fluoride in terms of photo-reactivity.

U.S. Pat. No. 6,592,202 discloses a recording head in which a rubber member as a part of an ink passage is used between a supply passage and a support member supporting a substrate. Such a rubber member is formed from rubber cross-linked by a metal oxide such as ZnO or MgO. Examples of the cross-linked rubber include butyl rubber and halogenated butyl rubber.

In the recording head disclosed in the foregoing publication, a channel forming member contains fluorine atoms composing a photo-acid generating agent or the like and, in addition, the rubber member may contain metal. In such a case, a very small amount of metal that is a cross-linking constituent contained in the rubber member may dissolve in the ink. The metal may be combined with the fluorine of the channel forming member, with the result that a compound of metal and fluorine may be deposited. Such a deposit may block a discharge port or stay near the discharge port, leading to discharge failure.

SUMMARY OF THE INVENTION

The present invention has been made to solve the drawbacks discussed above. It is, accordingly, an object of the present invention to provide an ink jet recording head that ensures satisfactory discharge of ink where a channel forming member contains fluorine atoms. Specifically, it is an object of the present invention to provide an ink jet recording head that prevents a deposit formed from a constituent of a rubber member.

An ink jet recording head in an example of the present invention has a substrate including: a discharge port forming member that forms a discharge port used to discharge ink; a channel forming member that forms an ink channel communicating with the discharge port; and a supply opening used to supply ink to the channel, at least either one of the channel forming member and the discharge port forming member comprising a substance having fluorine atoms. The recording head further has: a support member that forms a supply passage used to supply ink to the supply opening and supports the substrate; a supply passage defining member that forms the supply passage; and joint rubber that is cross-linked by an organic substance, is disposed between the support member and the supply passage defining member and forms the supply passage.

The ink jet recording head prevents a deposit formed from any constituent of joint rubber and thus ensures satisfactory discharge of ink.

DESCRIPTION OF THE EMBODIMENTS

Referring to the accompanying drawings, there will be described preferred embodiments of the present invention.

In the description below, where configurations are identical in function, they are labeled with an identical reference number shown in a corresponding drawing, and the explanation thereof may be omitted.

An ink jet recording head (also referred to as "a recording head") can be mounted in an industrial recording apparatus in combination with: a facsimile machine comprising printer, copier, and communication systems; a word processor or the like having a printer section; and various other processing devices. This recording head makes it possible to record images on various recording media such as paper, thread, fiber, cloth, leather, metal, plastic, glass, wood, and ceramic. The term "recording" in this specification refers to not only "forming on a recording medium an image such as a character or shape that has a meaning," but also "forming on a recording medium an image such as a pattern that has no meaning"

Further, the term "ink" may be widely interpreted. It refers to "any liquid used to form an image, design, pattern, etc., by being applied onto a recording medium, used to process a recording medium, or used to process ink or a recording medium." In this case, "to process ink or a recording medium" refers to "to improve fixability through solidification or insolubilization of a coloring material in ink applied to a recording medium," "to improve recording quality or color development," or "to improve image durability."

Figure 1:
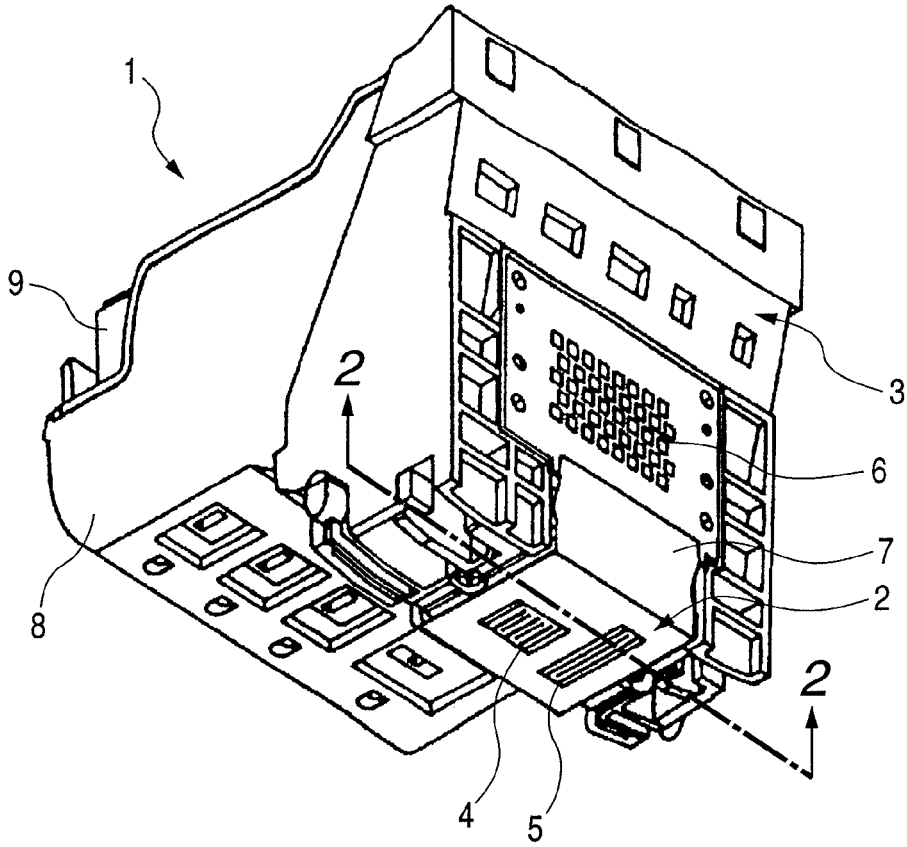
FIG. 1 is a schematic perspective view for explaining one example of an ink jet recording head according to the invention.

FIG. 1 is a schematic perspective view showing an example of an ink jet recording head of the present invention. The head of this type shown in FIG. 1 includes recording head sections forming a recording unit 2, one recording section having a recording element substrate 4 for cyan (C), magenta (M), and yellow (Y), and the other having a recording element substrate 5 for black (Bk). This head also includes: an electrically connectable section 6, which is electrically connected to the electrically connectable section of a recording apparatus (described below) when the recording head is mounted on the recording apparatus; and a flexible wiring board 7, which electrically connects the electrically connectable section 6 and the contact pads (not shown) of the two recording head sections. On the other hand, an ink supply unit 3 includes: a holder 8, which holds independent ink tanks 9 for the four different colors (C, M, Y, Bk); and ink supply passages along which inks are passed to corresponding lines of discharge ports from the ink tanks 9.

Figure 2:
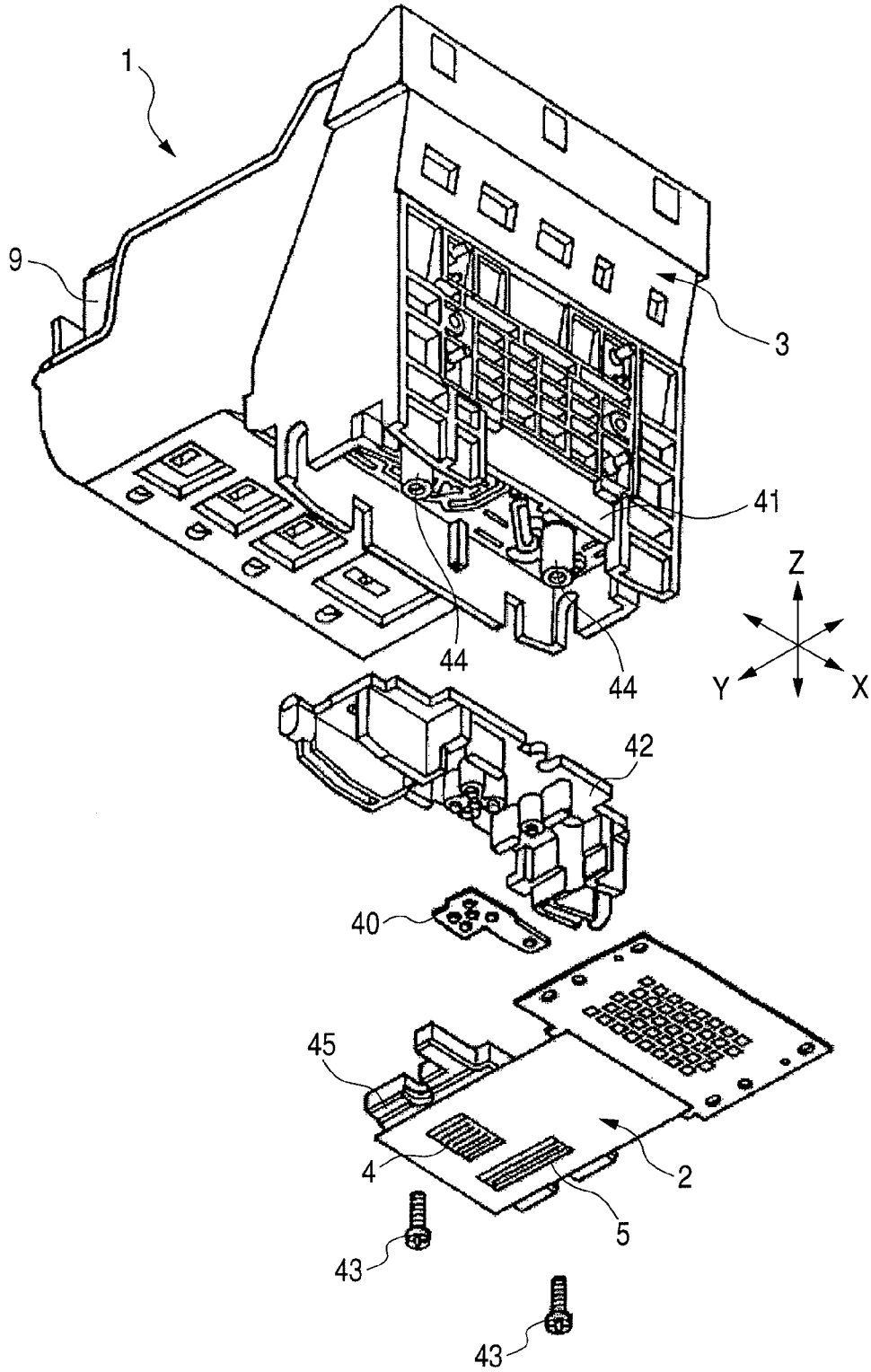
FIG. 2 is another schematic perspective view for explaining the example of the ink jet recording head according to the invention.

FIG. 2 is a partly exploded view of the ink jet recording head shown in FIG. 1. The recording head is formed by fitting together the recording unit 2, a joint rubber 40, an ink supply passage defining member 42, and an ink supply unit 3. An ink supply passage 70 (see FIG. 3) is formed by welding the ink supply part 41 of the ink supply unit and the ink supply passage defining member 42 by means of, for example, a supersonic wave and then joining the joint rubber 40 and a support member 45. This ink supply passage 70 is a part of an ink passage from an ink storage member to a channel. The joint rubber 40 is a rubber member used in the recording head and is disposed between the ink supply member 42 and the support member 45, as described below. The recording unit 2 and the ink supply unit 3 are joined together by fixing screws 43 into the screw bosses 44 of the ink supply part 41 so as to sandwich the ink supply passage defining member 42 and joint rubber 40. This prevents the joint between the ink supply part 41 and ink supply passage defining member 42 from being subject to stress in the direction in which parts 41 and 42 are disconnected from each other. In addition, using screws 43 makes it easy to disassemble the ink jet recording head for recycling. Fixing the screws 43 into the bosses 44 also fixes the recording unit 2 at a precise position in relation to a reference position in the X, Y, and Z directions of the ink supply unit 3. The recording element substrates 4 and 5 are respectively fixed to the support member 45.

Figure 3:
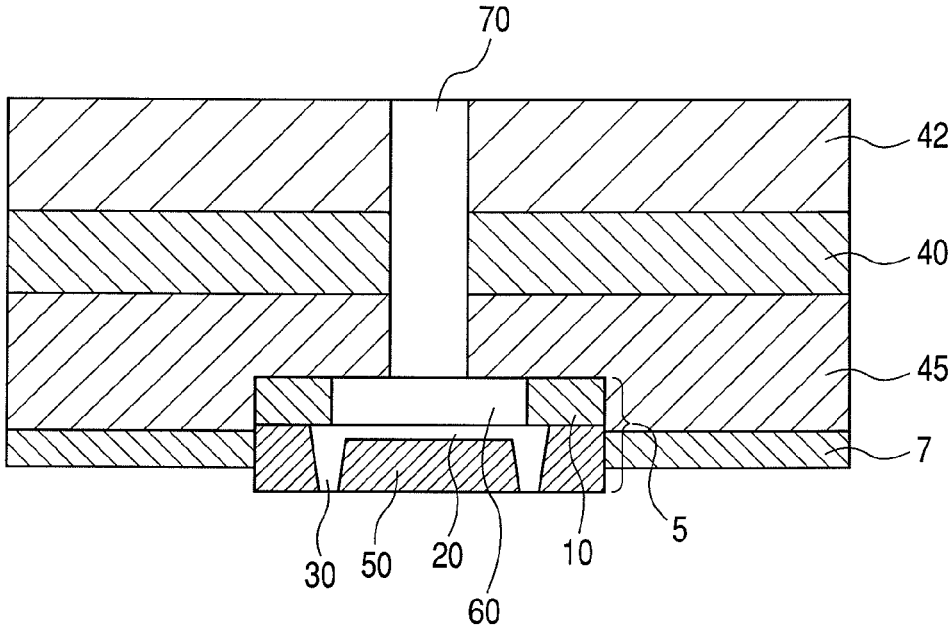
FIG. 3 is a schematic sectional view for explaining the example of the ink jet recording head according to the invention.

FIG. 3 is a schematic sectional view taken on the plane of the lines A-A' of FIG. 1 and perpendicular to the recording element substrate. FIG. 3 shows the configuration formed so that ink continuously flows from the ink tank, through the ink supply part 41 and then the supply passage 70 formed by the ink supply passage defining member 42, joint rubber 40 and support member 45, to the corresponding discharge port of the recording element substrate 5. The supply passage defining member 42 may be formed integrally with the ink tank.

The recording element substrate 5 has a substrate 10, and a discharge port forming member 50, which is formed on the substrate and forms the channel 20 and discharge port 30. In the example shown in FIG. 3, the channel 20 and discharge port 30 are formed by an integral member, but the channel 20 may formed by a channel forming member which is different from the discharge port forming member 30. The substrate 10 is a member defining the channel. The shape, material, etc., of the substrate 10 are not limited in particular, as long as the substrate 10 functions as a support for the nozzle plate and the members defining the channel and discharge port.

On the substrate are a desired number of liquid discharge energy production elements (not shown), such as electric conversion elements or piezoelectric elements, disposed so as to correspond with the discharge ports 30. These liquid discharge energy production elements produce energy for discharging ink. Using ink discharged from the discharge port, recording takes place. Referring to FIG. 3, there is shown a supply port 60 formed in the substrate 10 in order to supply ink. Through this supply port 60, ink can be supplied from the ink supply part to the ink channel. Any method by which a hole can be made in the substrate 10 suffices to form the supply port 60. For example, the supply port may be formed by mechanical means such as a drill, or optical energy such as a laser. Alternatively, the supply port 60 may be made by forming a resist pattern or the like on the substrate 10 and then chemically etching the substrate while using this pattern or the like as a mask.

Methods for forming the discharge port forming member and the channel forming member on the substrate are not limited in particular.

There will next be described the materials for the members used in the ink jet recording head of the present invention.

(Joint Rubber)

The joint rubber, as an example of a rubber member applicable in the present invention, is not limited in particular, as long as the rubber is cross-linked by a cross-linking agent. However, it is preferable that the rubber have a certain number of unsaturated bonds in its main chain. Specifically, as such a rubber, it is preferable to use at least one type selected from the group consisting of butyl rubber, brominated butyl rubber, chlorinated butyl rubber, nitrile rubber, hydrogenated nitrile rubber, and EPDM (ethylene-propylene-diene monomer) rubber. Using such rubbers secures a sealing member that excels in ink resistance and in joining the substrate and the ink supply part.

The joint rubber according to the invention comprises an organic cross-linking agent and rubber cross-linked by this organic cross-linking agent. Examples of such an organic cross-linking agent include organic multivalent amine compound, modified phenolic resin, and organic peroxide. The amount of organic cross-linking agent added to the rubber varies with the type and molecular weight of the cross-linking agent to be used, and with the efficiency of the cross-linking of a material rubber in accordance with the number of functional groups. However, it is preferable that the amount be equal to or greater than 0.5 parts by mass but equal to or less than 10.0 parts by mass based on 100 parts by mass of the rubber material.

Among organic cross-linking agents, organic peroxide is preferably used. Any organic peroxide (i.e., peroxide cross-linking agent) capable of cross-linking rubber may be used. Specifically, any one of the examples listed below may be used.

Dicumyl peroxide; benzoyl peroxide; 1,1-bis(t-butylperoxy) 3,3,5-trimethylcychlohexane; and 1,1-bis(t-butylperoxy)cyclododecane.

t-butylperoxybenzoate; di-t-butylperoxide; α, α'-bis(t-butylperoxy)di-isopropylbenzene.

2,5-dimethyl-2,5-di(t-butylperoxy)hexyne; 2,5-dimethyl-2,5-di(t-butylperoxy)hexane; dicumylperoxide (DCP).

In order to enhance the efficiency of rubber cross-linking, a cross-linking promoter may be used together with a multifunctional monomer capable of radical polymerization, such as m-phenylene bismaleimide, triallyl isocyanurate, trimethylolpropane triacrylate.

It is preferable to use such an organic cross-linking agent in an amount of 0.5 to 10.0 parts by mass inclusive based on 100 parts by mass of rubber. It is especially preferable that the amount be 1.0 to 5.0 parts by mass inclusive. Using such an amount of organic cross-linking agent makes it possible not only to effectively cross-link rubber but also to prevent the sealing member from dissolving into ink.

Additionally, it is suitable that the joint rubber 40 contain titanium oxide. This is because a resin composing the rubber may be blended with organic aliphatic acid, which can be absorbed by titanium oxide. If organic aliphatic acid in the rubber member dissolves in ink, it may form an aliphatic acid metal salt together with a very small amount of metal contained in the water, etc., in the ink. Titanium oxide in the joint rubber absorbs aliphatic acid, thus restraining precipitation of aliphatic acid or the like in the joint rubber. It is preferable that the diameter of the titanium oxide particles be approximately 1 μm. The amount of titanium oxide required to be blended in the joint rubber is extremely small, and will not affect the physical properties of the rubber. For example, the content of titanium oxide should be 1 wt %.

The rubber described above is suitable for use because it prevents ions, such as Mg ions, from dissolving in ink. Additionally, this rubber is suitable for use as material for rubber members in the recording head, with the exception of the joint rubber 45.

(Support Member)

The material composing the support member is not limited in particular, but it is preferable to use one that has a predetermined mechanical strength and forms an excellent bond with the substrate provided with the discharge port. Specific examples of such a material include ceramics (including glass and alumina), plastics, and metals.

(Supply Passage Defining Member)

It is preferable that the supply passage defining member 42 be formed from modified polyphenyleneether (PPE). The modified PPE is preferable in terms of strength, heat resistance, etc. In order to prevent a substance from dissolving in ink, it is preferable not to use inorganic filler. Further, when forming the member 42, it is preferable to use an organic lubricant containing no bivalent metal element such as olefin or paraffin oil. This will prevent metal ions from dissolving in the ink. Since inorganic filler should not be used, it is preferable to form the material of the supply passage defining member 42 from a resin containing 50% or more PPE.

(Function)

There will next be described the function of one example of the present invention.

In one example of the present invention, the member for defining the passage or channel is formed by curing a cationic polymerization resin with a cationic initiator (i.e., catalyst) containing fluorine atoms. In addition, a joint rubber member is formed from rubber cross-linked by an organic cross-linking agent. This prevents the constituents of the joint rubber from reacting with the constituents of the member defining the channel or discharge port, which might result in the production of a deposit.

(Discharge Port Forming Member and Channel Forming Member)

In the present invention, it is preferable to form the member defining the discharge port or channel with cationic polymerization resin. Compared to a hard substance formed by ordinary acid anhydride or amine, the cationic polymerization resin has high cross-linking density (High Tg) and, therefore, exhibits excellent characteristics as a material for a nozzle plate. In particular, photo-cationic polymerization resin is preferable because of its excellent patterning.

Any photo-cationic polymerization resin may be used as long as the chosen cationic polymerization group undergoes cationic polymerization by the emission of light such as ultraviolet. Examples of such cationic polymerization groups are a vinyl group and a circular ether group. However, a compound formed from an epoxy or oxetane group is suitable for use.

Specific examples of epoxy resins are listed below.

Bisphenol epoxy resin comprising monomer or oligomer having a bisphenol skeleton, such as bisphenol-A-diglycidyl ether; bisphenol-F-diglycidyl ether.

Phenolnovolac epoxy resin; cresolnovolac epoxy resin; trisphenolmethane epoxy resin; 3,4-epoxycyclohexenylmethyl-3',4'-epoxycyclohexene carboxylate.

Further, a resin having an epoxy group as a side-chain of an alicyclic skeleton represented by the following formula (1) is also suitable for use.

(1)

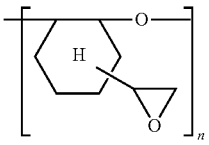

(wherein n represents an integer)

In addition, a novolac resin having a bisphenol A skeleton, which has a structure represented by the following formula (2) is also suitable for use. In the formula, it is suitable that n be an integer from 1 to 3, particularly n=2.

(2)

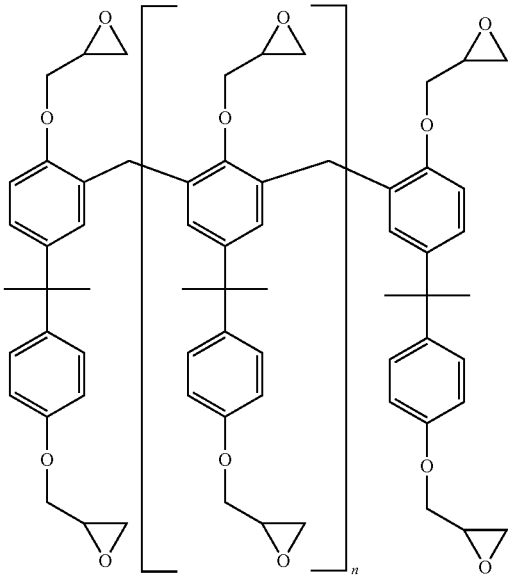

Examples of oxetane compounds are listed below.

Phenolnovolac oxetane compound; cresolnovolac oxetane compound; trisphenolmethane oxetane compound; bisphenol oxetane compound; and biphenol oxetane compound.

As long as the effect of the present invention is not degraded, each of the cationic polymerization resins listed above may be used alone, or two or more of them may be used in combination.

An additive or the like may be added to such a cationic polymerization resin as necessity requires. For instance, a flexibility imparting agent may be added in order to decrease the modulus of elasticity of a hard substance or a silane coupling agent may be added in order to increase adhesion between the discharge port forming member or channel forming member and substrate. A sensitizing agent can also be added in order to increase photo-absorption.

A curing agent for the foregoing cationic polymerization resin will now be described.

(Curing Catalyst)

A curing agent used in the present invention initiates cationic polymerization by emission of light such as ultraviolet and, in order to enhance reactivity, a photo-acid generating agent containing anions including fluorine atoms is suitable for use. The photo-acid generating agent generally comprises cations and anions. When the photo-acid generating agent is subjected to emission of light such as ultraviolet, the cations absorb the ultraviolet. This induces liberation of acid from the anions. This acid acts on a cationic polymerization group, thus making the cationic polymerization effective.

It is desirable that the photo-acid generating agent used in the present invention include anions with fluorine atoms, be highly reactive, and cause effective cationic polymerization. Using this catalyst ensures a chain transfer reaction such that once the reaction starts, a cationic polymerization resin can be polymerized, cross-linked, and cured at a relatively low temperature, in a short time and at high cross-linking density. This makes it possible to obtain the high mechanical strength required for members used to form the discharge port and channel for the ink jet recording head.

Such a catalyst can be selected from the following known catalysts: $BF_4^-$ salt, $B(C_6F_5)_4^-$ salt, $PF_6^-$ salt, $AsF_6^-$ salt, $SbF_6^-$ salt, and $CF_3SO_3^-$ salt of aromatic onium compounds such as diazonium, ammonium, iodonium, sulfonium and phosphonium.

Specific examples of the photo-acid generating agent include iodonium salt such as diphenyliodonium trifluoromethylsulfonic acid salt represented by the following formula (3).

(3)

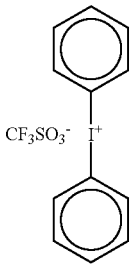

In addition, sulfonium salt or the like such as triphenylsulfoniumhexafluoroantimonate represented by the following formula (4) can also be used.

(4)

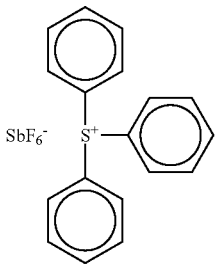

Below are other examples of photo-acid generating agents.

N-hydroxynaphthalimido-trifuluoromethanesulfonate
N-hydroxyphthalimide-trifuluoromethanesulfonate
Bis(4-t-butylphenyl)iodonium-trifuluoromethanesulfonate
Triphenylsulfonium-trifuluoromethanesulfonate
Tris(4-t-butylphenyl)sulfonium-trifuluoromethanesulfonate
Triphenylsulfonium-trifuluoromethanesulfonate
Tris(4-t-butylphenyl)sulfonium-hexafluoroantimonate
Tris(4-t-butylphenyl)sulfonium-tetrafluoroantimonate Commercially available photo-acid generating agents are: UVI6976 manufactured by The Dow Chemical Company, and SP-172, SP-170, SP-150, etc, manufactured by Adeka Corporation.

As long as the effect of the present invention is not degraded, each of the photo-acid generating agents listed above may be used alone, or two or more of them may be used in combination.

In addition, such a catalyst may be used together with a reducing agent. This makes it possible to accelerate cationic polymerization by the application of heat, in addition to the emission of ultraviolet. Accordingly, cross-linking density can be improved compared to where cationic polymerization is carried out only by emitting ultraviolet while utilizing a catalyst only. Where the photo-oxidizing catalyst and the reducing agent are used together, a reaction does not take place at normal temperatures and, therefore, a reducing agent that reacts at a specific temperature or above (preferably 60° C. or above), namely a redox type reducing agent, must be used. A copper compound, ascorbic acid, or the like may be used as such a reducing agent.

First Embodiment

In the first embodiment, a recording head was formed in a manner as described below.

First, a recording element substrate having a member in which a channel and a discharge port would be formed was formed on a substrate.

Figure 4A:
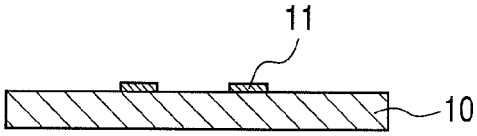
FIGS. 4A, 4B, 4C, 4D, 4E, 4F, and 4G are schematic sectional views showing an example of a part of a process of a method for manufacturing the ink jet recording head according to the present invention.

Specifically, a silicon substrate 10 having heaters 11 was prepared (FIG. 4A).

Figure 4B:
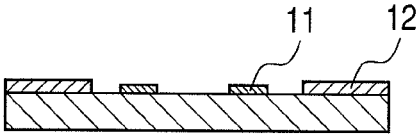

Next, an adherence layer 12 of polyetheramide resin was formed on the substrate (FIG. 4B).

Figure 4C:
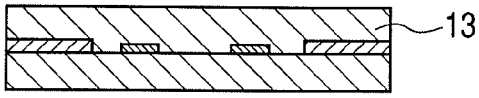

Subsequently, polymethylisopropenylketone resin 13 was deposited on the substrate (FIG. 4C).

Figure 4D:
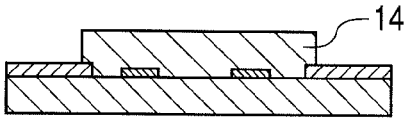

Then, the polymethylisopropenylketone resin 13 was patterned to form a pattern 14 in an area corresponding to an ink channel (FIG. 4D).

Figure 4E:
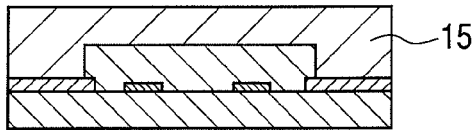
Figure 4F:
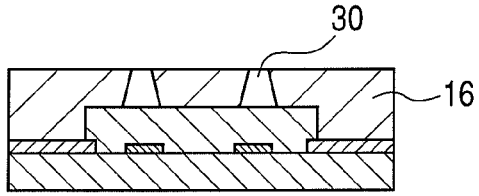
Figure 4G:
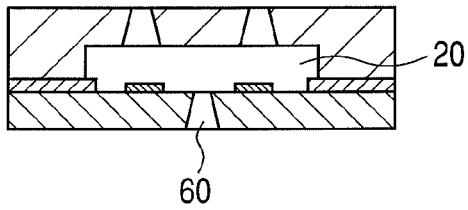

Next, the surface of the substrate was spin-coated with a solution prepared by dissolving a composition I of materials listed in table 1 into xylene (a xylene/composition I ratio=1:1). Thereafter, the coating of solution was heated and dried at 60° C. for nine minutes and, thus, a covering layer 15 was formed (FIG. 4E). The catalyst in the table below contains fluorine atoms.

TABLE 1

| Material | Trade Name (Manufacturer) | Content (wt %) |
|---|---|---|
| Epoxy Resin | EHPE-3150 (Dicel Chemical Industries, LTD.) | 93 |
| Catalyst | SP-170 (Adeka Corporation) | 2 |
| Silane Coupling Agent | A-187 (Nippon Unicar Company Limited) | 5 |

Subsequently, using "mask aligner MPA600" (trade name) manufactured by Canon Inc., a silicon wafer on which the covering layer 15 had been formed was exposed for five seconds through a pattern mask used to form an ink discharge port. Next, this silicon wafer was baked such that the cationic polymerization resin underwent a cationic polymerization reaction at 90° C. for three minutes, and was then cured. Thus, the discharge port forming member 16 for defining the discharge port 30 was formed.

Next, the pattern 14 was removed by a solvent, thereby defining the channel 20. This means that the wall member of the channel 20 and the discharge port forming member 16 were both formed from the composition I.

Lastly, the supply opening 60 was formed in the substrate 10. A recording element substrate thus obtained was joined to the support member 45 formed from ceramic. Thereafter, this support member 45 was bonded, through the joint rubber 40, to the ink supply passage defining member 42 formed from a thermoplastic resin. Required electrical connections and so on were then carried out. Thus, the ink jet recording head as shown in FIG. 1 was formed. Brominated butyl rubber was used as the sealing member. This rubber had been cross-linked using dicumyl peroxide, which is an organic cross-linking agent.

The ink tank for the ink jet recording head thus formed was filled with ink (water/glycerin/direct black 154 (water-soluble black dye)=65/30/5). Then, a preservation test was conducted by storing the recording head at 70° C. or below for 24 hours. The results showed no foreign matter in the discharge port and ink channel. Image formation was carried out using the recording head mounted in an apparatus. As a result, satisfactory images were formed.

Second Embodiment

There will next be described a second embodiment of the present invention. The second embodiment differs from the first embodiment in the following respects: composition II (Table 2) was used as the material of the covering layer 15 and hydrogenated nitrile rubber was used as a joint rubber. This hydrogenated nitrile rubber was cross-linked using dicumyl peroxide as an organic cross-linking agent. SP-172 in Table 2 is a photo-polymerization initiator containing fluorine atoms.

An ink jet recording head was formed in the same manner as in the first embodiment in the other respects.

TABLE 2

| Material | Trade Name (Manufacturer) | Content (wt %) |
|---|---|---|
| Epoxy Resin | EHPE-3150 (Dicel Chemical Industries, LTD.) | 90 |
| Catalyst | SP-172 (Adeka Corporation) | 6 |
| Silane Coupling Agent | A-187 (Nippon Unicar Company Limited) | 4 |

The ink jet recording head thus formed was subjected to a preservation test in the same manner as in the first embodiment. The results have shown no foreign matter. Satisfactory images were formed as in the first embodiment.

Third Embodiment

There will next be described a third embodiment of the present invention. The third embodiment differs from the first embodiment in the following respects: composition III (Table 3) was used as the material of the covering layer 15 and hydrogenated nitrile rubber was used as a joint rubber. This hydrogenated nitrile rubber was cross-linked using dicumyl peroxide as an organic cross-linking agent. UVI6976 in Table 3 is a photo-polymerization initiator containing fluorine atoms.

An ink jet recording head was formed in the same manner as in the first embodiment in the other respects.

TABLE 3

| Material | Trade Name (Manufacturer) | Content (wt %) |
|---|---|---|
| Epoxy Resin | Epicoat1001 (Japan Epoxy Resins CO. LTD.) | 94 |
| Catalyst | UVI6976 (Dow Chemical Company) | 2 |
| Silane Coupling Agent | A-186 (Nippon Unicar Company Limited) | 4 |

The ink jet recording head thus formed was subjected to a preservation test in the same manner as in the first embodiment. The results showed no foreign matter. Satisfactory images were formed as in the first embodiment.

Comparative Example

An ink jet recording head was formed in the same manner as in the first embodiment except that chlorinated butyl rubber cross-linked by MgO was used as a joint rubber. The ink jet recording head thus formed was subjected to a preservation test in the same manner as in the first embodiment. The test shows that magnesium fluoride was deposited on the ink discharge port and ink channel. Recording was carried out using this recording head. However, the beginning of consecutive emissions of ink, expectedly adequate results were not obtained from some images. It is estimated that the direction of emission of the ink droplets might have been diverted from the predetermined one due to the deposition of the magnesium fluoride.

Accordingly, it is found from the results of evaluations of the recording heads of the first to third embodiments and a comparative example that it is suitable that rubber cross-linked by an organic cross-linking agent be used as the joint rubber where discharge port and channel forming members are formed using a polymerization initiator containing fluorine atoms.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-139157, filed May 25, 2007 and 2007-218217, filed Aug. 24, 2007, which are hereby incorporated by reference in their entirety.

What is claimed is:

1. An ink jet recording head comprising:

a substrate including a discharge port member provided with a discharge port used to discharge ink, and a channel member provided with a part of an ink channel communicating with the discharge port and a supply opening used to supply ink to the ink channel, at least one of the channel member and the discharge port member comprising a substance having a fluorine atom;

a support member for supporting the substrate, the support member provided with a part of an ink passage continuous with the supply opening;

a supply passage defining member provided with a supply passage communicating with the ink passage; and a rubber member forming a part of the supply passage, the rubber member being cross-linked by an organic substance.

2. An ink jet recording head according to claim 1, wherein the rubber member contains hydrogenated nitrile rubber.

3. An ink jet recording head according to claim 1, wherein the rubber member contains brominated butyl rubber.

4. An ink jet recording head according to claim 1, wherein the organic substance is peroxide.

5. An ink jet recording head according to claim 4, wherein the peroxide is dicumyl peroxide.

6. An ink let recording head according to claim 4, wherein the peroxide is benzoyl peroxide.

7. An ink jet recording head according to claim 1, wherein at least either one of the channel member and discharge port member is formed from a cured product obtained from epoxy resin and a curing agent of the epoxy resin containing fluorine atoms.

8. An ink jet recording head according to claim 7, wherein the curing agent is a photo-cationic polymerization initiator.

9. An ink jet recording head according to claim 8, wherein the curing agent is triphenylsulfoniumhexafluoroantimonate.

10. An ink jet recording head according to claim 1, wherein the rubber member contains titanium oxide.

11. An ink jet recording head according to claim 1, wherein the rubber member forming a part of the supply passage is provided downstream of an ink flow when the ink is discharged with respect to the ink channel.

* * * * *